United States Patent [19]

Lazarus

[11] 4,433,483

[45] Feb. 28, 1984

[54] RAZOR ASSEMBLY

[76] Inventor: Wayne P. Lazarus, Fernleigh Rd., Fernleigh via Ballina, New South Wales, Australia

[21] Appl. No.: 376,037

[22] Filed: May 7, 1982

[30] Foreign Application Priority Data

May 8, 1981 [AU] Australia ..... PE 8764
Aug. 14, 1981 [AU] Australia ..... PF 0234

[51] Int. Cl.[3] ..... B26B 21/44
[52] U.S. Cl. ..... 30/41; 30/86
[58] Field of Search ..... 30/41, 86, 125

[56] References Cited

U.S. PATENT DOCUMENTS

| | | | |
|---|---|---|---|
| 1,867,980 | 7/1932 | Melka | 30/41 |
| 2,686,361 | 8/1954 | Resnick et al. | 30/41 |
| 2,786,270 | 3/1957 | Orlando et al. | 30/41 |
| 2,866,265 | 12/1958 | Kells | 30/41 |
| 3,176,391 | 4/1965 | Resnick et al. | 30/41 |
| 3,417,468 | 12/1968 | Miyauchi | 30/41 |
| 3,726,009 | 4/1973 | Hackmyer | 30/41 |
| 3,783,511 | 1/1974 | Pass | 30/41 |
| 4,023,269 | 5/1977 | Lopez, Jr. | 30/41 |
| 4,074,428 | 2/1978 | Roberts | 30/41 |
| 4,077,119 | 3/1978 | Sellers | 30/41 |

FOREIGN PATENT DOCUMENTS 759830 10/1956 United Kingdom .

*Primary Examiner*—Jimmy C. Peters
*Attorney, Agent, or Firm*—Fleit, Jacobson, Cohn & Price

[57] ABSTRACT

A disposable razor assembly has a handle portion comprising an elongate aerosol canister containing shaving foam and having a foam release valve at one end thereof; and a head portion comprising a cap removably attached to the handle portion and enclosing the valve, and a razor head mounted on the cap; the arrangement being such that the cap must be removed to allow foam to be dispensed.

4 Claims, 5 Drawing Figures

RAZOR ASSEMBLY

Figure 1:
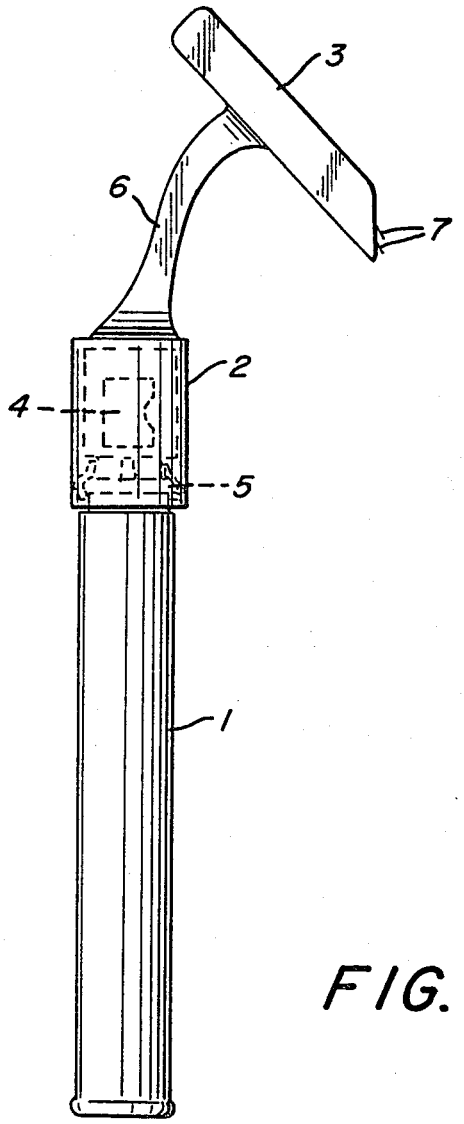
Figure 2:
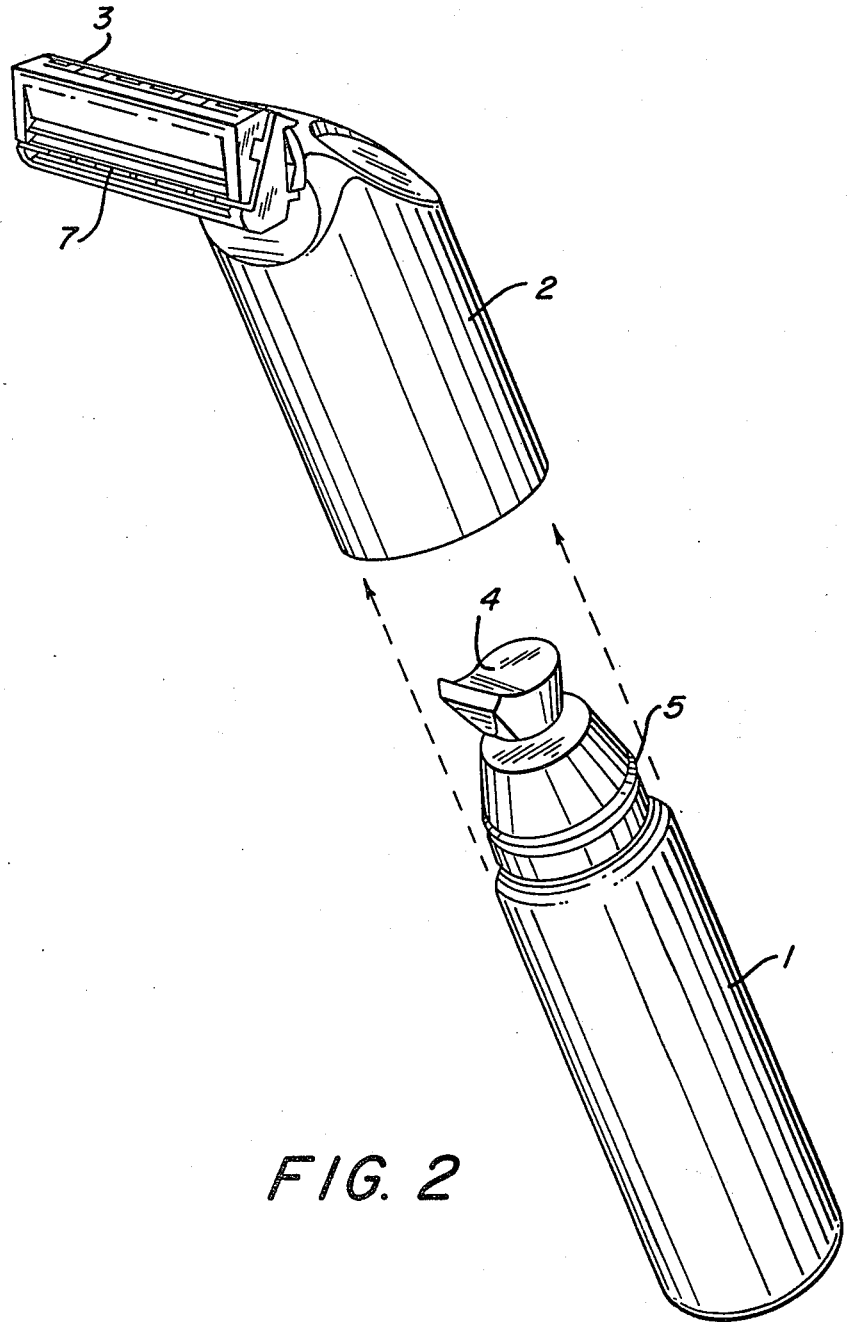
Figure 5:
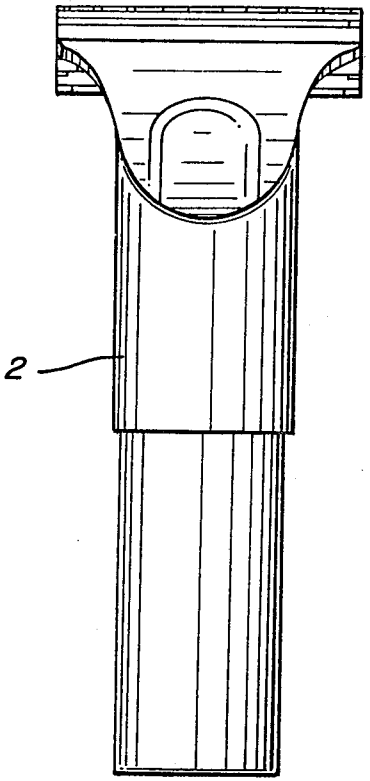
Figure 4:
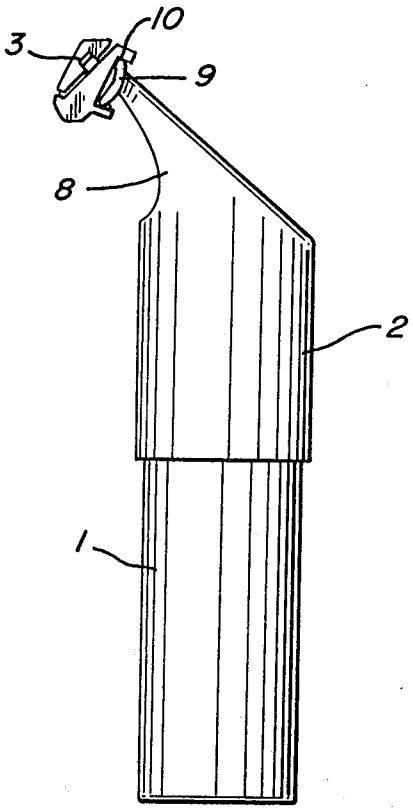
Figure 3:
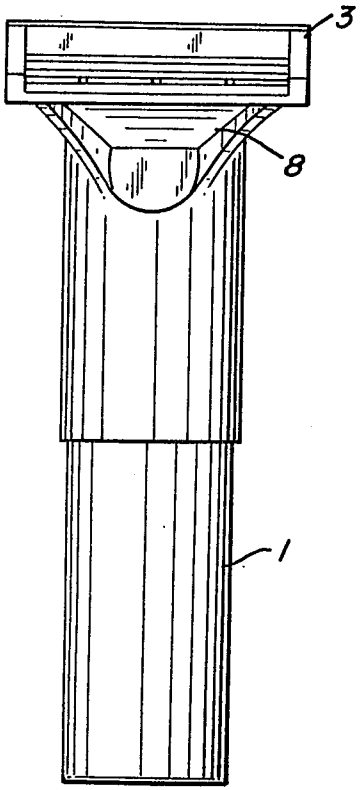

The present invention relates to a disposable razor assembly.

In spite of the advent of electric razors, the wet razor is still a very popular means of shaving. However, for the traveller the carrying of the necessary wet shaving requisites often presents a problem due to the number and shape of the various items required.

There have been a large number of prior proposals for an assembly which combines a razor head with a reservoir of shaving lubricant e.g. foam or cream. These proposals generally fall into two categories, firstly those where the shaving foam is directed onto the blade of the razor head or onto the face immediately before the razor head, and secondly those where the foam is dispensed for application onto the face in a separate operation prior to actual shaving.

Typical of the first category are U.S. Pat. Nos. 3,417,468 and 4,077,119. However, it is generally desirable for the foam to be applied to the face sometime before shaving occurs to enable the beard to become softened. Such proposals do not allow for this.

The second category includes U.S. Pat. Nos. 1,867,980, 3,783,511 and 4,023,269 wherein the shaving foam is dispensed onto a brush or other spreading implement provided in the razor assembly for application to the face prior to shaving. These proposals have usually been unduly complicated since the necessity to direct the foam to a particular location has required a construction which hindered access to the valve or outlet of the foam reservoir, thereby leading to a complicated and correspondingly expensive item.

It is an object of the present invention to provide a disposable razor assembly of simple construction which is cheap enough to manufacture to allow the whole item to be thrown away after use.

The present invention provides a disposable razor assembly, which comprises a handle portion comprising an elongate aerosol canister containing shaving foam and having a foam release valve at one end thereof; and a head portion comprising a cap removably attached to the handle portion and enclosing the valve, and a razor head mounted on the cap; the arrangement being such that the cap must be removed to allow foam to be dispensed.

Thus, there is provided in a single assembly all the requisites to enable wet shaving to be carried out. This is particularly useful for travellers who may buy the razor assembly (for example from a slot machine) without the need to purchase a number of different items, possibly involving the need to visit a number of shops. The assembly is compact and cheap to produce and is generally thrown away after use. The aerosol canister will normally contain at least sufficient foam to outlast the life of the razor head. In fact, it may often be desirable to sell a spare razor head with the assembly.

The handle portion is normally constituted by the elongate aerosol canister itself. For this purpose, the canister will generally be cylindrical, 5 to 10 cm long and 0.5 to 3 cm in diameter. It is possible that the handle portion may also include a casing containing the aerosol canister.

The head portion comprises a cap and a razor head. The cap is removably connected to the handle portion and serves to protect the valve and to prevent accidental release of foam. The cap is attached to the handle portion in such a way that the cap does not become released from the handle during normal shaving operations. The cap may be frictionally attached as a push-fit, but is normally formed as a snap-fit. Alternatively, the cap may be in screw-threaded engagement or bayonet-engagement with the handle portion.

The razor head is of conventional construction and may include one or two blades. Normally, the head portion will be formed of injection-moulded plastics material and the blade or blades will be embedded in the plastics during the moulding operation. Suitable plastics include polyethylene, polypropylene and polycarbonate.

It is particularly advantageous if the head is pivotally mounted to the cap to allow swivelling of the head around an axis transverse to the direction of the handle portion during shaving. This allows the head to adopt an optimal shaving orientation.

The razor assembly is equally applicable to men and women.

Embodiments of the invention will now be described in conjunction with the drawings, wherein FIG. 1 is a side elevation of a first embodiment, and FIGS. 2 to 5 show various views of a second embodiment of the invention.

The razor assembly of FIG. 1 comprises an aerosol canister 1 having removably attached thereto a razor head 3 mounted on a cap 2.

The handle portion is formed of an aerosol canister 1 containing shaving foam having a valve 4 at an upper end thereof.

The cap 2 is a snap-fit on the canister 1. For this purpose, a ridge 5 is formed around the upper end of the aerosol canister 1 and a corresponding groove is formed in the inside surface of the cap 2.

The razor head 3 is attached to the cap 2 by means of a pylon 6. The whole head portion is injection moulded from a plastics material. Twin razor blades 7 are provided in the razor head.

The razor assembly may be purchased as a complete unit and is compact and easy to carry around. In use, the cap is removed from the aerosol canister and shaving foam applied to the face. The cap is then replaced, the handle portion grasped in the hand and shaving carried out in the normal way. When the aerosol canister becomes empty, the whole assembly is then thrown away. The assembly may be produced at an economical price.

FIGS. 2 to 5 show a second embodiment of the invention. This is generally similar to the first embodiment except that the razor head 3 is slidably mounted on the cap.

The cap 2 is provided with a wide neck portion 8 having at an upper end thereof a transverse bar 9. The head 3 includes a channel 10 having inwardly turned edges for slidably embracing the bar 9. In this way the razor may be replaced when the blades are blunt by a new head, simply by sliding off the old head and sliding on a new one.

In a particulary preferred form, the head is pivotally mounted onto the neck portion 8, so that the head may swivel about a transverse axis (i.e. about an axis extending along the length of the head) to allow the head to adopt an optimal orientation during shaving.

I claim:

1. A disposable razor assembly, which comprises a handle portion comprising an elongate aerosol canister containing shaving foam and having a foam release valve at one end thereof; and a head portion comprising a cap removably attached to the handle portion and enclosing the valve, and a razor head mounted on the cap; the arrangement being such that the cap must be removed to allow foam to be dispensed.

2. An assembly according to claim 1 wherein the aerosol canister constitutes the handle portion.

3. An assembly according to claim 1 or 2 wherein the razor head is removably mounted on the cap, the cap comprising a bar extending transversely to the canister and the razor head being slidably mounted on the bar.

4. An assembly according to any preceding claim wherein the razor head is pivotally mounted on the cap to allow pivoting around the longitudinal axis of the head.

* * * * *